US009890533B2

(12) United States Patent
Nanayakkara

(10) Patent No.: US 9,890,533 B2
(45) Date of Patent: Feb. 13, 2018

(54) METAL STUD FRAME ELEMENT

(71) Applicant: Lakdas Nanayakkara, Boca Raton, FL (US)

(72) Inventor: Lakdas Nanayakkara, Boca Raton, FL (US)

( * ) Notice: Subject to any disclaimer, the term of this patent is extended or adjusted under 35 U.S.C. 154(b) by 0 days.

(21) Appl. No.: 14/861,780

(22) Filed: Sep. 22, 2015

(65) Prior Publication Data

US 2017/0081852 A1 Mar. 23, 2017

(51) Int. Cl.

| | |
|---|---|
| ***E04C 3/32*** | (2006.01) |
| ***E04B 1/30*** | (2006.01) |
| ***E04B 2/60*** | (2006.01) |
| *E04B 1/24* | (2006.01) |

(52) U.S. Cl.

CPC ..... *E04C 3/32* (2013.01); *E04B 1/30* (2013.01); *E04B 2/60* (2013.01); *E04B 2001/2475* (2013.01); *E04B 2001/2481* (2013.01)

(58) Field of Classification Search

CPC ..... E04C 3/32; E04C 3/36; E04C 3/30; E04B 2001/2475

USPC ..... 52/855, 648.1, 649.1, 649.2, 653.1, 831, 52/846, 483.1, 241, 356, 414, 600, 52/309.12, 309.14, 334

See application file for complete search history.

(56) References Cited

U.S. PATENT DOCUMENTS 1,004,859 A * 10/1911 Dowd ..... E04B 2/723 52/289
1,472,373 A * 10/1923 Megenity ..... E04B 1/4178 52/714
2,127,973 A * 8/1938 Isett ..... E01C 11/14 122/510
3,230,684 A * 1/1966 Vinje ..... E04F 13/0803 403/345
3,303,627 A * 2/1967 Mora ..... E04C 3/20 52/634
3,550,898 A * 12/1970 Citrullo ..... E04G 17/045 249/189
3,722,157 A * 3/1973 Prokop ..... E06B 1/6023 52/241
3,991,534 A * 11/1976 Brumlik ..... E04B 1/49 24/442
4,064,996 A * 12/1977 Shillum ..... A47B 57/402 108/107
4,222,211 A * 9/1980 Pearson ..... E04B 2/7881 52/241
4,704,835 A * 11/1987 Jordan ..... E04B 2/7457 52/489.1
4,885,884 A * 12/1989 Schilger ..... E04B 5/04 52/354
5,325,651 A * 7/1994 Meyer ..... E04B 2/766 52/243

(Continued)

*Primary Examiner* — Babajide Demuren
(74) *Attorney, Agent, or Firm* — Melvin K. Silverman

(57) ABSTRACT

A construction system includes a metallic stud definable in terms of an X, Y, Z coordinate system. The system includes a Z-axis elongate substantially rectangular integral web within a YZ plane, the web having a stability elements along a Z axis line of dependency with a first edge of the web, the elements defining an L-shaped element having a foot occupying a YZ plane substantially parallel to the web. The system also includes a second and opposite Z-axis edge of the web defining a series of trapezoidal cut-outs having openings at a minor base of each trapezoidal cut-out.

10 Claims, 11 Drawing Sheets

(56) References Cited

U.S. PATENT DOCUMENTS

| | | | | |
|---|---|---|---|---|
| 5,592,796 | A * | 1/1997 | Landers | E04B 2/7457 52/241 |
| 6,615,563 | B1 * | 9/2003 | Nanayakkara | E04B 1/165 52/846 |
| 6,988,347 | B2 * | 1/2006 | Nanayakkara | E04B 1/165 52/648.1 |
| 7,051,484 | B2 * | 5/2006 | Nanayakkara | E04B 1/165 52/309.12 |
| 7,308,778 | B2 * | 12/2007 | Nanayakkara | E04B 1/165 52/309.12 |
| 7,571,578 | B2 * | 8/2009 | Moody | E04B 2/58 52/241 |
| 7,617,648 | B2 * | 11/2009 | Moody | E04B 2/7457 52/481.1 |
| 7,703,247 | B2 * | 4/2010 | Surowiecki | E04B 2/7457 52/241 |
| 8,245,466 | B2 * | 8/2012 | Wright | E04B 2/7457 52/241 |
| 8,689,511 | B2 * | 4/2014 | Fleming, III | B32B 15/10 52/36.1 |
| 2014/0119815 | A1 * | 5/2014 | Brady | E04F 13/0803 403/287 |
| 2015/0059275 | A1 * | 3/2015 | Nanayakkara | E04B 1/165 52/348 |

* cited by examiner

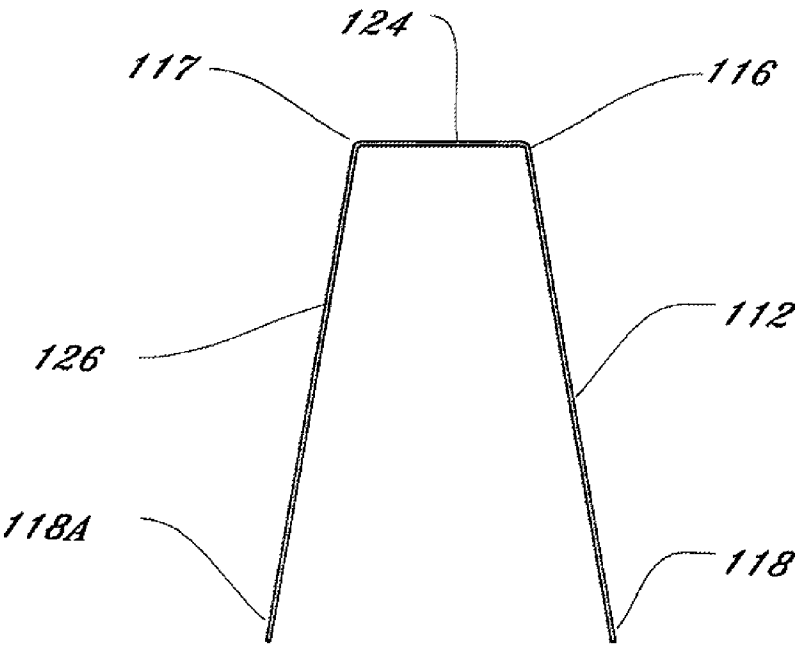
FIG. 9A
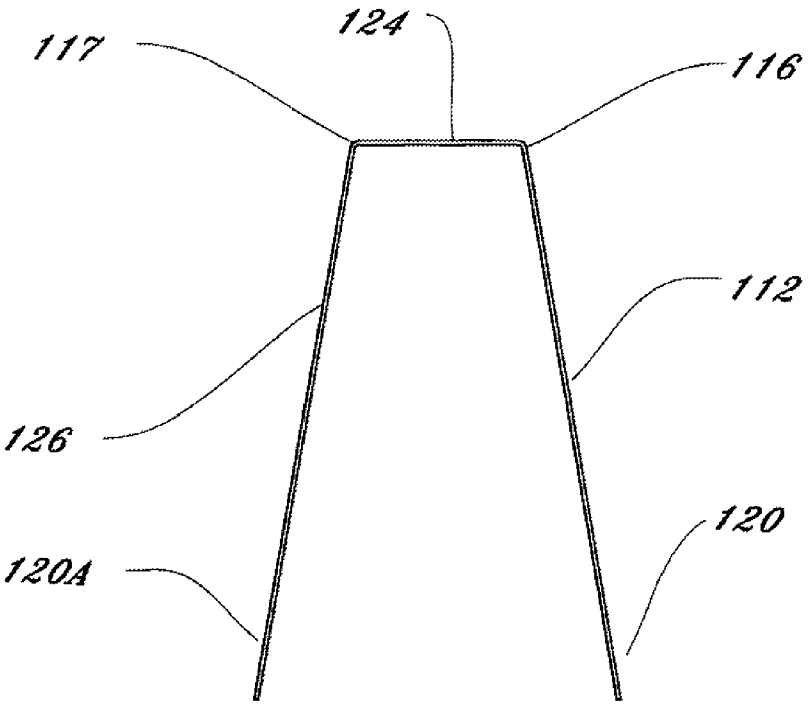
FIG. 9
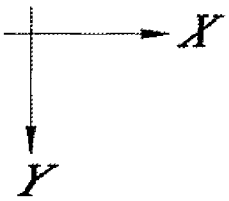

METAL STUD FRAME ELEMENT

BACKGROUND OF THE INVENTION

The present invention relates to metallic stud frames of a type used in the formation of a frame of a residential, commercial or industrial structure.

Historically, frames of such structures were formed of either wood, or concrete. In the case of load bearing structures, it is common to use a steel bar, known as rebar within a poured concrete structure. The use of vertical light gauge steel studs, in lieu of wooden studs to accomplish internal framing within a wood frame structure, is also well known in the art. It is, however, not known to employ thin gauge vertical studs in combination with exterior wall concrete framing in which the vertical stud elements operates to define an offset of distance between an exterior poured concrete wall and an interior plasterboard wall which is secured to one surface of such a vertical steel stud element.

A need for such a vertical steel stud frame element has arisen as a consequence of rapid on-site assembly techniques employing thin external concrete walls which have developed in the construction arts. The present invention therefore relates to such vertical metallic stud elements in which one rectilinear surface thereof may be poured as a part of a process of casting of an exterior concrete wall, its base and/or a load bearing resultant structure.

The need for such an improved metal stud frame element has long existed in the art.

SUMMARY OF THE INVENTION

A construction system includes a metallic stud definable in terms of an X, Y, Z coordinate system. The system comprises a Z-axis elongated substantially rectangular integral YZ web within a YZ plane thereof, said web having stability means members along a Z axis line of dependency with a first edge of said YZ web, said means members defining an L-shaped element having a foot occupying a YZ plane substantially parallel to said YZ web. The system also includes a second and opposite Z-axis edge of said web defining a series of substantially trapezoidal cut-outs therein having an opening thereto at a minor base of each trapezoidal cut-out.

The stud is preferably formed of a thin gauge steel.

It is accordingly an object of the present invention to provide a metallic stud framing element particularly adapted for use within a concrete framing structure.

It is another object to provide a metallic stud of the above type which can function as an interior to exterior wall-defining offset.

It is a further object of the invention to provide a vertical metallic stud capable of defining the shape and extent of vertical load bearing concrete columns within a poured concrete structure.

The above and yet other objects and advantages of the present invention will become apparent from the hereinafter set forth Brief Description of the Drawings, Detailed Description of the Invention and Claims appended herewith

BRIEF DESCRIPTION OF THE DRAWINGS

FIGS. 9 and 9A are transverse cross-sectional views of the structure of FIG. 8.

DETAILED DESCRIPTION OF THE INVENTION

Figure 1:
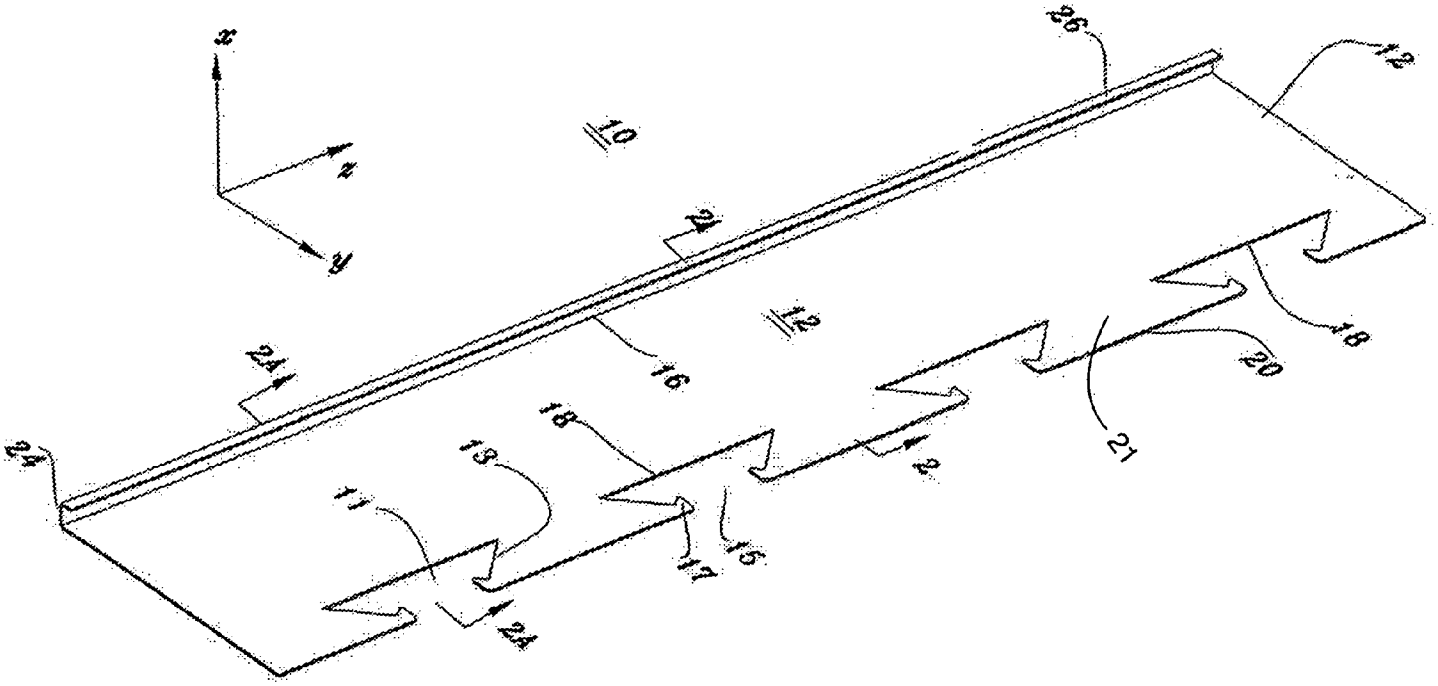
FIG. 1 is a perspective view of a first embodiment of an inventive metallic stud.

With reference to the perspective view of FIG. 1, the present inventive metal stud element for use in framing systems, as set forth above, may be seen to be definable in an X, Y, Z coordinate system as shown in FIG. 1.

More particularly, an inventive stud element 10 includes an integral web 12 having a Z-axis elongate structure within YZ plane, which structure is substantially rectangular. The web 12 includes an elongated members 24/26 which depends upwardly in the X-axis direction and then bends back in the YZ direction of the web as is reflected in element 26. See also FIGS. 2 and 2A Upon opposite edge 20 of web 12 is shown a plurality of interdigitated trapezoids which, more particularly, include individual trapezoidal cut-outs 11 separated by complemental non-cut-out opposite trapezoids 20 21. The mouth of each trapezoid is indicated by reference numeral 15, while the major base thereof is represented by reference numeral 18. The slanted sides 13 connect mouth 15 to major base 18 of each trapezoidal cut-out. As may be noted, the trapezoidal cut-outs 11 exhibit a unique geometry at their mouths 15 which more particularly, is defined by hook-like structures 17 which point inwardly in the direction of major base 18 and stabilizing means members 22/24 24/26.

Figure 2:
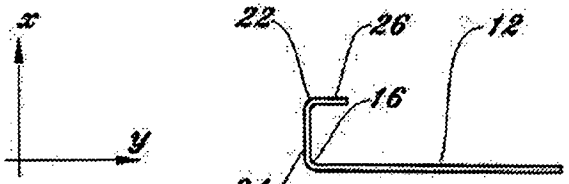
FIG. 2 is a transverse cross-sectional view taken through Line 2-2 of FIG. 1.
Figure 2A:
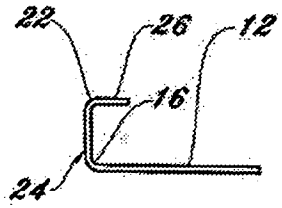
FIG. 2A is a transverse cross-sectional view taken through Line 2A-2A of FIG. 1.

The structure of FIG. 1 is shown in further detail in FIGS. 2 and 2A which are cross-sectional views taken, respectively, through Lines 2-2 and 2A-2A. Therein it may be appreciated that the transverse width of web 12 is less at the cross-section 2A-2A than at cross-section 2-2. In all other respects, the web 12 and L-shaped element 24/26 constitute stabilizing members of each metallic stud frame element. As may be appreciated in my U.S. Pat. No. 6,988,347, the cross-sectional geometries of FIGS. 2 and 2A may, in a given application, be expressed with considerable additional complexity.

Figure 3:
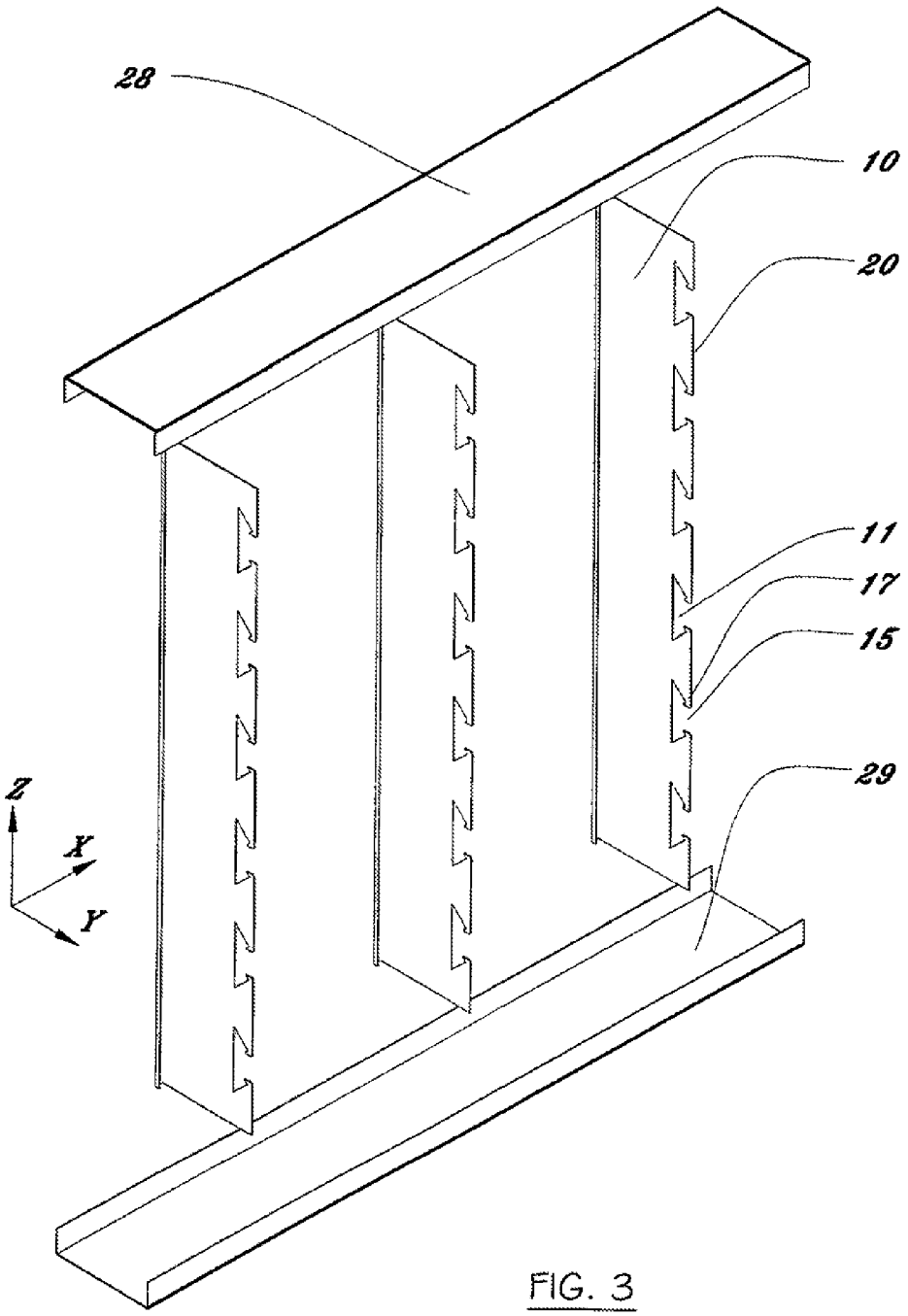
FIG. 3 is an exploded view showing the stud frame of FIG. 1 in combination with upper and lower system framing elements.

In FIG. 3 is shown a plurality of the above metal stud frame elements 10 oriented in a vertical position and in exploded view relative to top and bottom securement beams 28 and 30 respectively.

Figure 4:
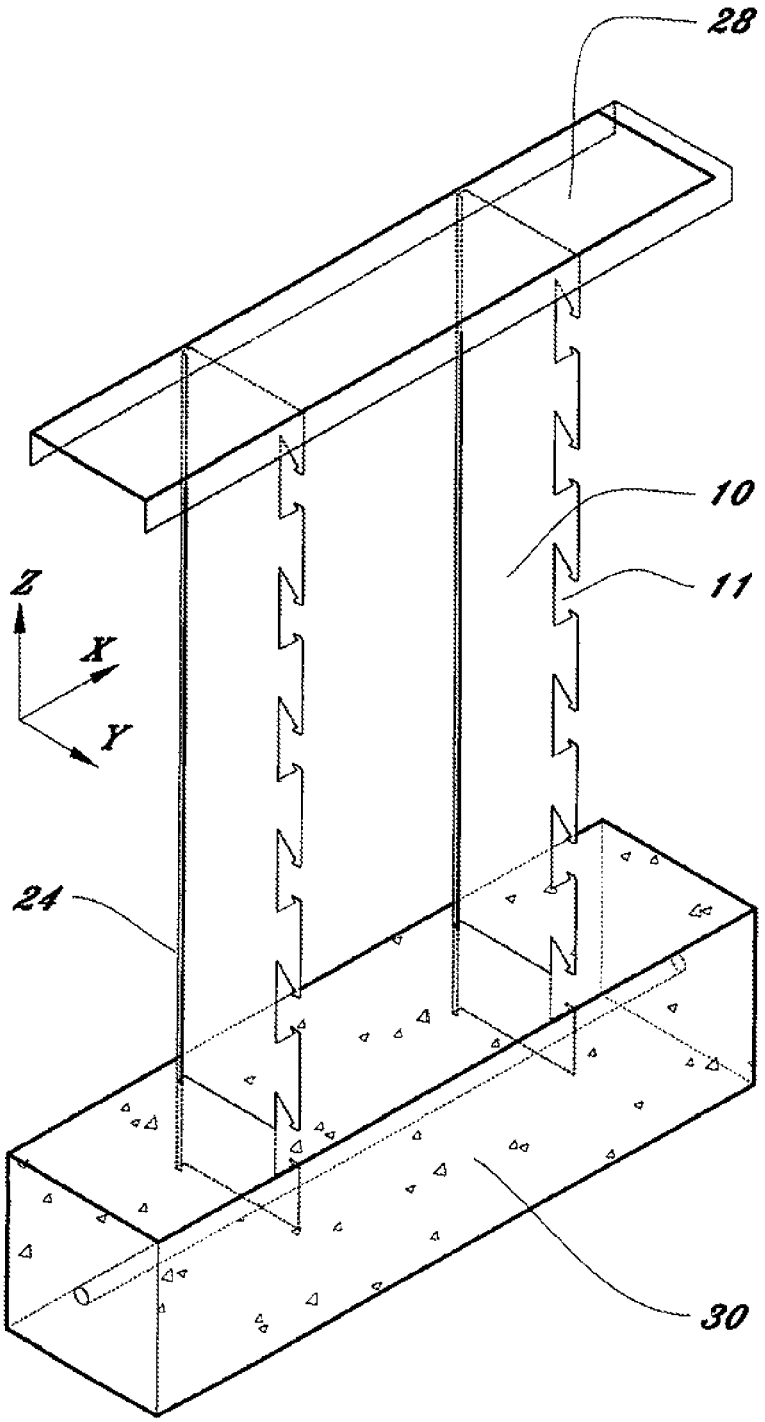
FIG. 4 is a view, further to the view of FIG. 3, in which a concrete upper and lower base of a resultant structure is formed.

FIG. 4 is a view, substantially similar to that of FIG. 3 in which, however, the bottom portion of each metal stud frame element 10 has been embedded within a concrete capstan.

Figure 5:
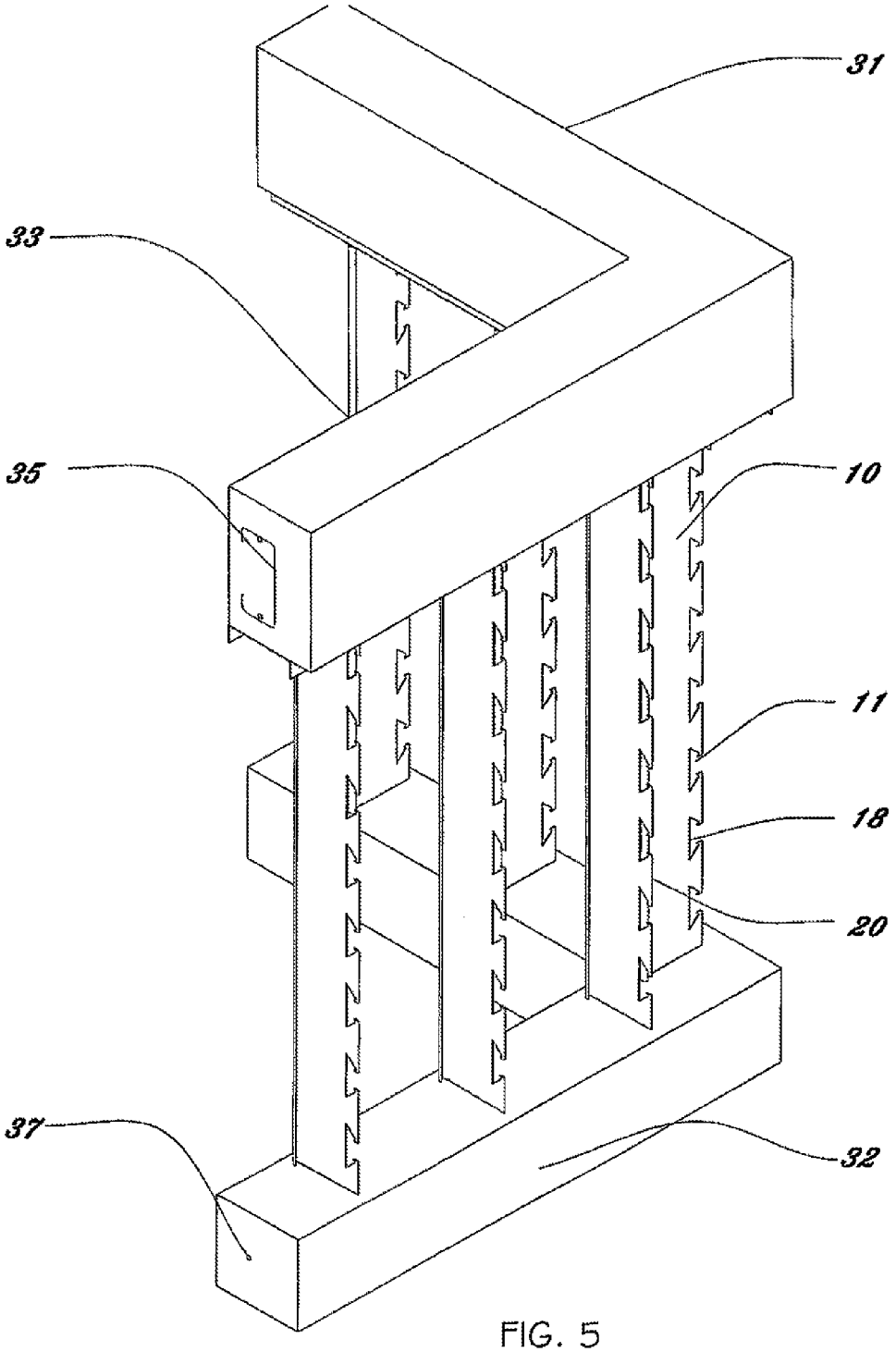
FIG. 5 is an assembly view of FIG. 4.

FIG. 5 is a view, generally similar to that of FIG. 4 in which, however, each upper portion of each metal stud frame element is embedded within each upper capstan 31 while the bottom region of each metal stud frame is embedded within a lower capstan or footing 32. Shown at reference numeral 35 of FIG. 5 is one geometry which rebars may take in the upper capstan 31 of the system.

A further rebar is shown as reference numeral 37 in footing 32.

Figure 6:
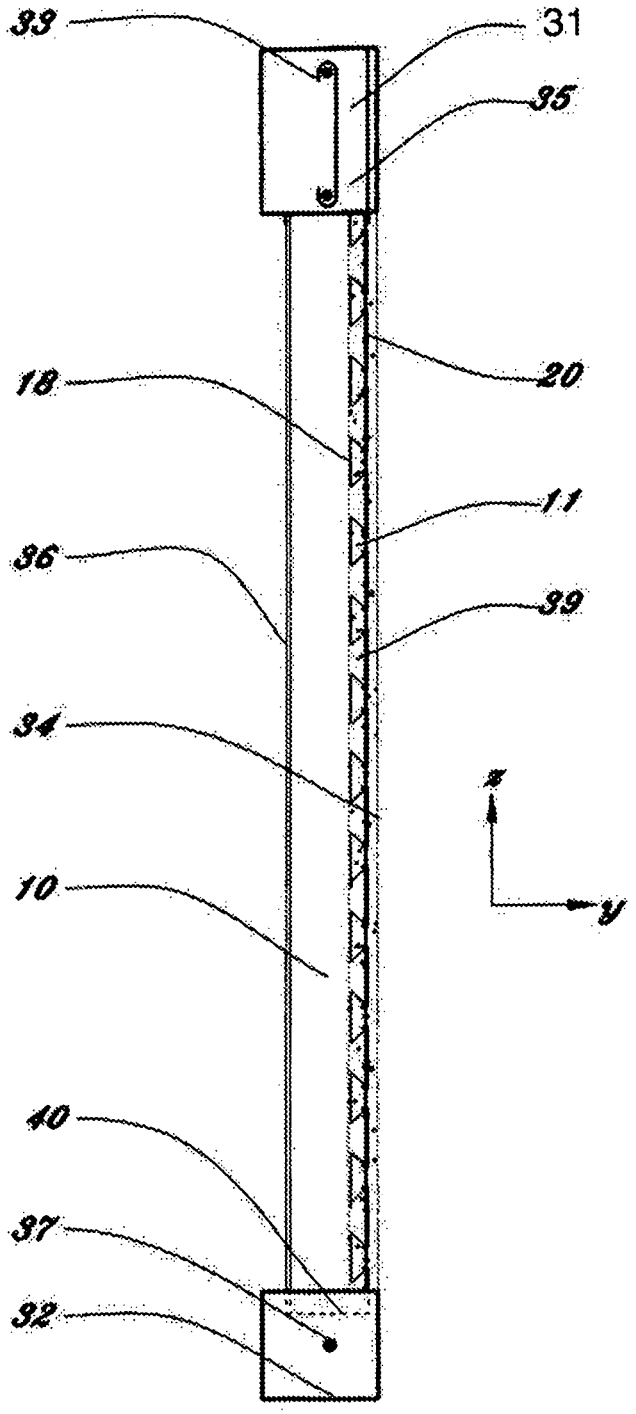
FIG. 6 is a vertical YZ plane sectional view of a resultant structure showing the inventive stud wholly embedded within a poured concrete exterior wall.

FIG. 6 shows the manner in which non-cut-out portions or tabs 20, interdigitating between trapezoidal geometries 11, may be fully embedded within a thin concrete wall 34 which forms an exterior of the structure to be framed. Therefrom the utility of the present metal stud frame may be appreciated with respect to both thin concrete and plasterboard construction. FIG. 6 further shows an elongate U-shaped double rebar 33 which may be used to hang a wall consisting of a plaster board vertical section 36 and a concrete upper capstan 29.

Figure 7:
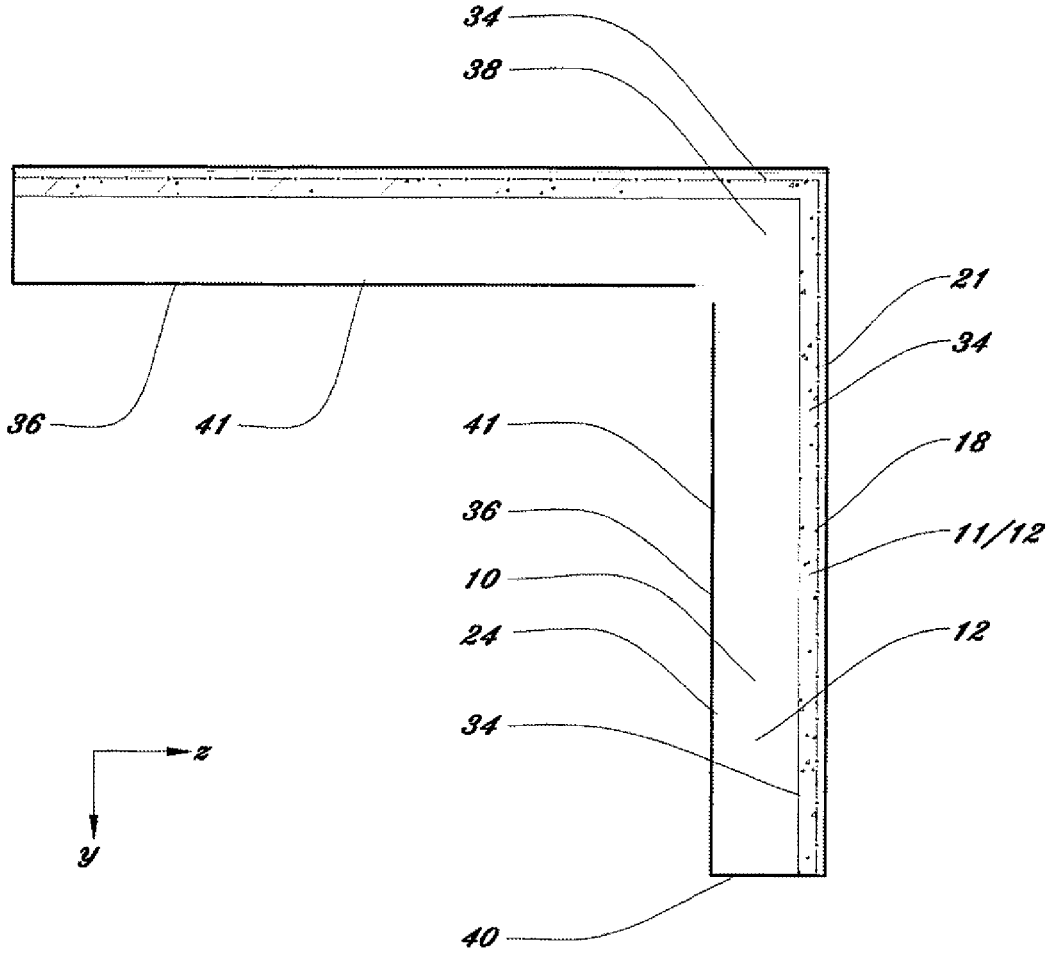
FIG. 7 is a view, further to the view of FIG. 5, including a concrete capstan and base in the XY plane of a resultant structure.

The structure of FIGS. 5 and 6 may be seen in horizontal cross-sectional view in FIG. 7, in which the trapezoidal cut-outs 11 of the metal stud frame element 10 may be seen embedded within concrete wall 34 and plywood layer 41 may be seen optionally placed upon plasterboard 36 or in lieu thereof.

As may be seen, web 12 spans the entire cross-sectional distance between the opposite trapezoidal edge 20 of the metal stud frame and stabilizing or L-shaped surface 24/26 thereof. Therefrom, it may be appreciated that pre-formed walls may be effectively constructed in accordance with the present method and that the rebar assembly 33 (see FIGS. 6 and 7) may be employed to essentially hang the stud frame system from the upper capstan 29 of the system. Therein, in FIG. 6 may be further noted that the stud element are countersunk into the upper capstan and lower footing as is indicated by dotted lines 35 and 40 respectively.

With reference to FIGS. 8 through 11, there is shown a second embodiment of the present invention which, generally, corresponds to the above-described structures of FIGS. 1-4 of the first embodiment of the invention. More particularly, in FIG. 8 it may be seen that the second embodiment thereof differs from FIG. 1 only its elimination of L-shaped or stabilizing edge 24 and, in lieu thereof provides an elongated XZ plane surface 124 upon which respective webs 112 and 126 are folded downwardly within a frusto-conical cross-section which is essentially symmetric about a YZ longitudinal plane of the embodiment of FIG. 8. The structure of FIG. 8 follows, in salient part, that of the metal web 12 of FIG. 1 including, trapezoidal cut-outs 111/111A at edge 120/120A. In each web 112/126 is provided bases 118/118A of each trapezoidal cut-out, interdigitating uncut portions 121/121A, and sidewalls 113 which connects mouths 115 of each cut-out to the bases 118 thereof. The embodiment of FIG. 8, as in the embodiment of FIG. 2, also displays hooks or angulated edges 117 of each mouth 115, the purpose of which is to ensure securement of the plurality of trapezoidal cut-outs within the cement slabs 30 within which uncut portions 121 are secured. See FIG. 11.

Figure 8:
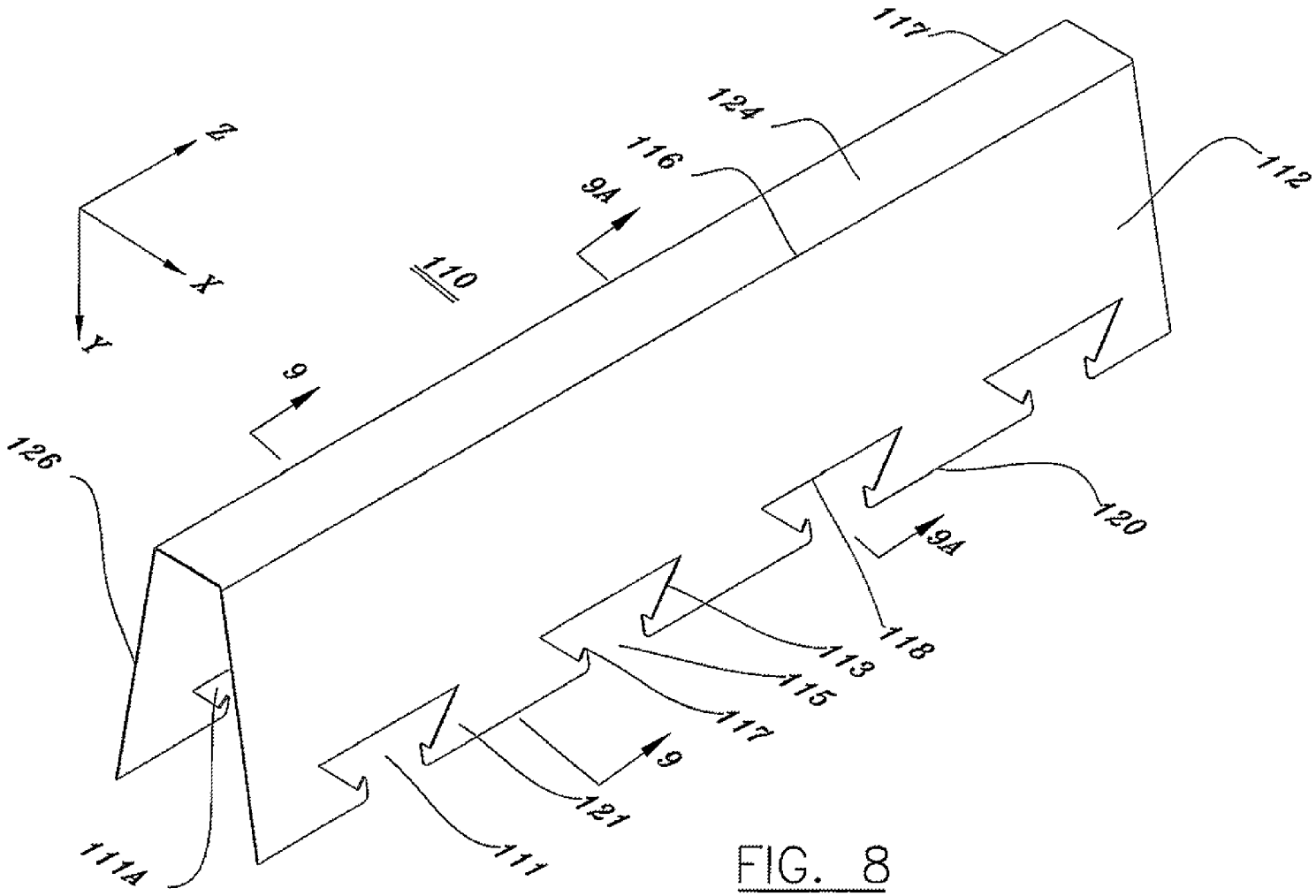
FIG. 8 is a perspective view of a second embodiment of the invention.

FIGS. 9 and 9A are cross-sectional views take through Lines 9-9 and 9A-9A of FIG. 8. Therefrom, the greater length of material in the cross-sections metal frame stud element which exists between the trapezoidal cut-outs may be appreciated. As may be further noted, each edge of each metal stud web of the embodiment of FIGS. 8 and 9 may have different lengths as may be noted from the distance of surface 124 to edges 118/118A versus edges 120/120A.

Figure 10:
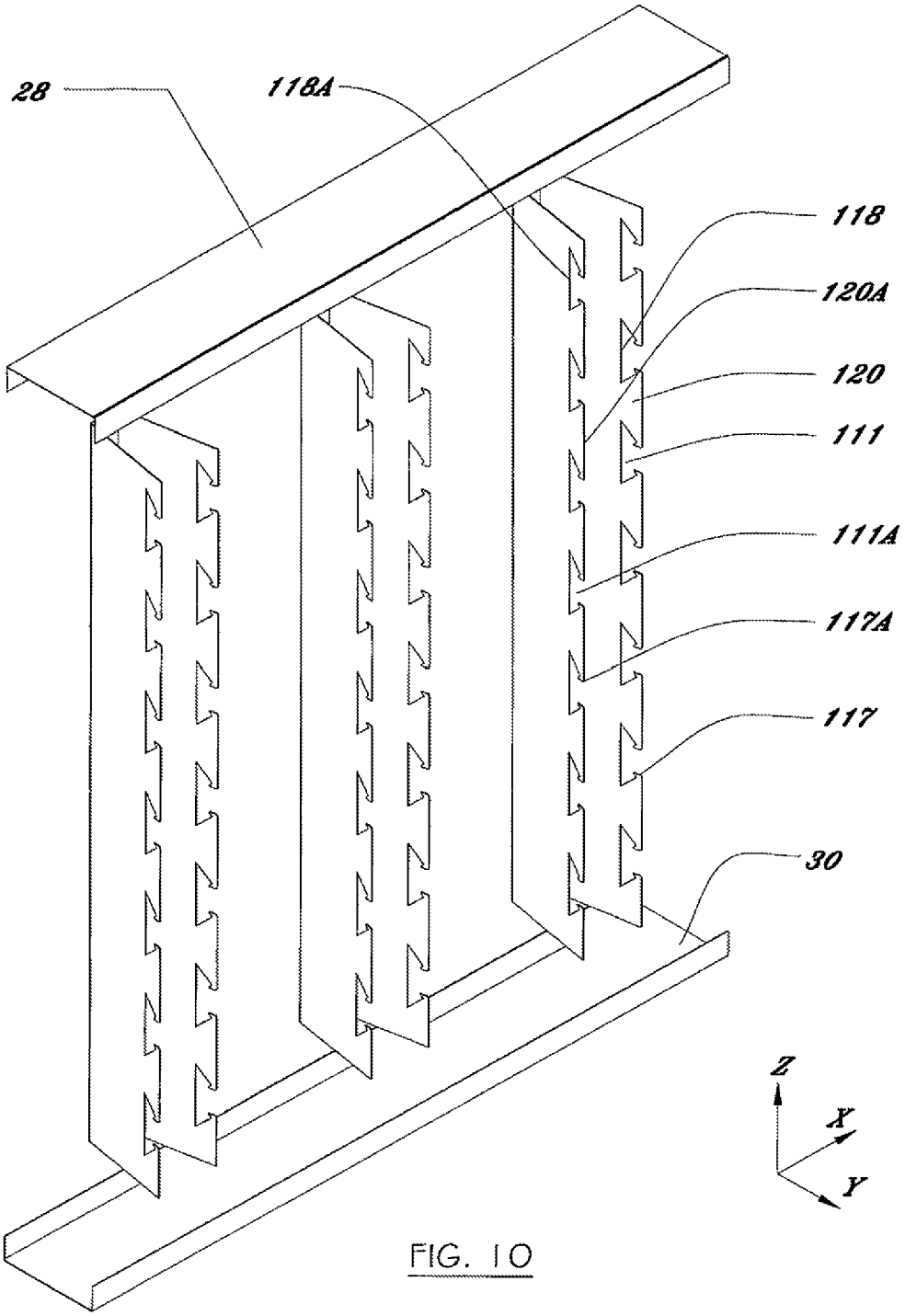
FIG. 10 is a view of the second embodiment otherwise similar to that of FIG. 3.

FIG. 10 is a view, generally similar to that of FIG. 3, showing that the second embodiment of the stud frame element may be used in a substantially identical fashion to that of the simpler geometry of embodiment 1.

Figure 11:
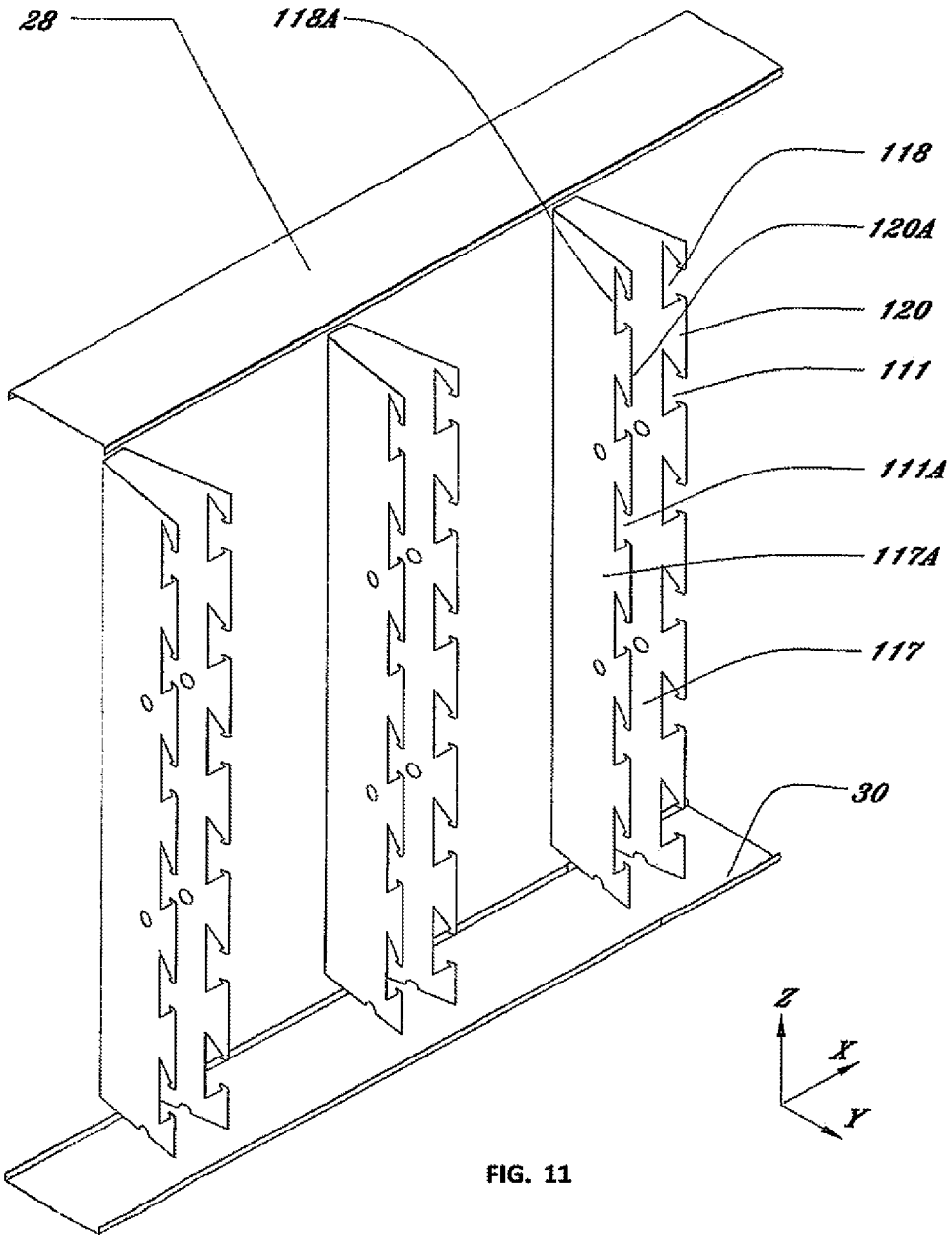
FIG. 11 is a view further to FIG. 10 and similar to that of FIG. 4.

In FIG. 11 is a view substantially similar to that of FIG. 4, from which, however, may be appreciated the enhanced truss-like strength of the second embodiment of the invention from which, as a practical matter, given a sufficient gauge of the metal truss frame elements, structures resultant from the assembly of FIG. 11 are virtually impossible to bend under any known wind and storm conditions. The embodiment as shown in FIG. 11 may be equipped in the fashion of FIGS. 6 and 7 with concrete outer surfaces to render yet more stable and wind resistant the entirety of the structure.

Figure 12:
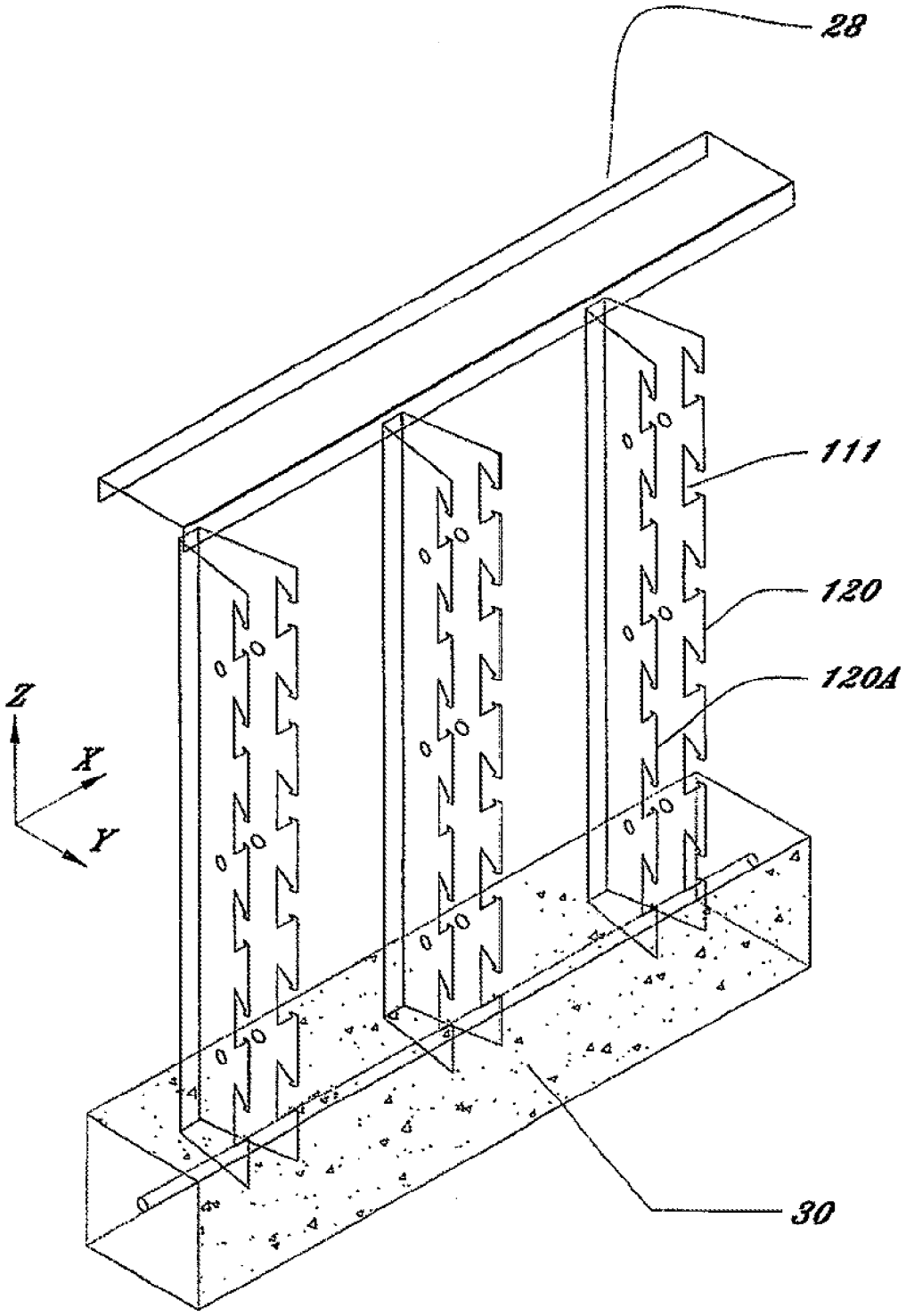
FIG. 12 is a view of the embodiment to FIGS. 8-11 including a concrete capstan and base.

FIG. 12 is a view of the embodiment of FIGS. 8-11 including a concrete capstan 30 as the base of the structure.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A construction system including a metallic stud definable in terms of X, Y, Z coordinate axes, the construction system comprising:

(a) a Z-axis elongated substantially rectangular integral YZ web within a YZ plane thereof, said web having stabilizing members along a Z axis line of dependency with a first Z-axis edge of said YZ web; and (b) a second and opposite Z-axis edge of said web defining a series of trapezoidal cut-outs on the YZ web therein having an inner major base and an opening thereof at a minor base of each trapezoidal cut-out on the YZ web; and (c) said edge of said opening of said cut-out defines opposing pointed tooth elements directed in a Y-axis direction toward each major base of each of said cut-outs on said YZ web.

2. The system as recited in claim 1, in which said stabilizing members defines an L-shaped element having a foot occupying a YZ plane substantially parallel to said web.

3. The system as recited in claim 2, in which a relationship of a y-axis dimension of said web to an x-axis dimension of tabs of greater dimension defines a ration in a range of about 6:1 to about 2:1.

4. A construction system including a metallic stud definable in terms of an X, Y, Z coordinate system, the construction system comprising:

(a) a Z-axis elongated double YZ web having a common XZ plane base, each of said YZ webs essentially symmetric along a YZ plane of said system, each web depending at a pre-selected angle from respective Z-axis edges of an XZ plane base;

(b) free edges of each YZ web each defining a series of substantially trapezoidal cut-outs therein having an opening thereof at a minor base of each trapezoidal cut-out; and (c) said edge of said opening of said cut-out defines opposing tooth elements directed in a negative Y direction toward each major base of each said cut-outs on the YZ web.

5. The system as recited in claim 4, in which said series of trapezoidal cut-outs of one web are not in XY cross-sectional alignment with those of the second web.

6. The system as recited in claim 4, in which angulations of each respective web to said common XZ plane base are not equal.

7. The system as recited in claim 4, in which angulations of each respective web to said common XZ plane base are not equal.

8. The system as recited in claim 5, in which XY plane lengths of said webs are not equal.

9. The system as recited in claim 5, in which angulations of each respective web to said common XZ plane base are not equal.

10. The system as recited in claim 7, in which XY plane lengths of respective webs are not equal.

* * * * *